US005224469A

United States Patent [19]

Mocny

[11] Patent Number: 5,224,469

[45] Date of Patent: Jul. 6, 1993

[54] QUANTITATIVE ACUPRESSURE DEVICE

[76] Inventor: Michael A. Mocny, 2965 Calle Noguera, Santa Barbara, Calif. 93105

[21] Appl. No.: 455,228

[22] Filed: Dec. 22, 1989

[51] Int. Cl.[5] ..... A61H 23/00

[52] U.S. Cl. ..... 128/55; 128/54; 128/60; 128/61; 128/774; 73/81; 73/82

[58] Field of Search ..... 128/55, 54, 60, 61, 128/774, 744; 606/204; 73/81, 82

[56] References Cited

U.S. PATENT DOCUMENTS

| | | | |
|---|---|---|---|
| 1,657,765 | 1/1928 | Pasqué | 128/55 |
| 3,841,321 | 10/1974 | Albach et al. | 128/36 |
| 4,554,930 | 11/1985 | Kress | 128/774 |
| 4,641,661 | 2/1987 | Kalarickal | 128/744 |
| 4,827,914 | 5/1989 | Kamazawa | 128/36 |
| 4,976,272 | 12/1990 | Bazin et al. | 128/774 |

*Primary Examiner*—Edgar S. Burr

*Assistant Examiner*—Lisa Malvaso

*Attorney, Agent, or Firm*—Michael G. Petit

[57] ABSTRACT

A device for applying therapeutic or analgesic pressure quantitatively which includes a sensor for continuously measuring the pressure on a patient's skin and underlying tissue. The instrument includes a hand-held force sensitive transducer having a blunt tip extending therefrom. When the blunt tip of the device is pressed against the skin thereby compressing the underlying tissue, the transducer yields an electrical signal proportional to the applied pressure. This signal is then fed to a resettable digital display. When the pressure applied to the skin reaches a threshold value, an actuator switch is actuated starting a timer which measures the elapsed time period during which the skin and underlying tissue is exposed to the measured pressure. An optional alarm indicates when the combination of pressure and elapsed time has reached a previously determined level.

1 Claim, 2 Drawing Sheets

QUANTITATIVE ACUPRESSURE DEVICE

BACKGROUND OF THE INVENTION

1. Field of the Invention

This invention relates to a device for measuring and applying pressure to the skin and underlying tissue of a patient in therapeutic or analgesic quantities. Such a device is useful to therapists and physicians in treating ailments responsive to acupressure or acupuncture or trigger point therapy.

2. Prior Art

Health care practitioners have used a patient's sensitivity to externally applied pressure as a diagnostic tool for at least thirty-five years. The sensitivity to external pressure was indicated by bilateral variation, in pain threshold, is considered symptomatic of certain ailments. Certain neurological and other medical examinations and procedures entail the location and delineation of areas of analgesia or hyposthesia, the former being the absence of pain or touch sensitivity; the latter, reduced pain or touch sensitivity. Also of interest is hyperalgesia, that is, enhanced sensitivity to painful stimuli. Such tests are normally carried out in special examinations for the treatment of neurological disorders as well as in general medical checkups and in diagnosing various diseases.

Cutaneous sensations are transmitted from the skin to various regions of the cerebral cortex. Thus, sensations of touch as well as those of warmth and coolness are perceived and interpreted in particular regions of the somesthetic or bodily sensor area of the parietal lobe. The sensation of pain for each side of the body is conducted to the brain independently. Hence, the sensitivity of a particular area of the body may be compared with a reference area on the opposite side thereof. This comparison, as mentioned above, is useful in diagnosis because as the involvement of the sensory nervous system is unilateral.

In U.S. Pat. No. 4,641,661, Kalurukal describes a device called an algesimeter. The instrument, which is a pain threshold gauge, includes a hand-held pressure sensitive transducer terminating in a pointed probe. When the point of the probe is pressed against the skin, the transducer then yields an electrical signal proportional to the applied pressure, this signal being fed to a resettable digital display. When the pressure applied to the skin reaches a threshold value (at which the patient experiences pain), a switch is actuated by the patient or the health care practitioner to retain the digital indication at that value whereby it may be read by the practitioner and recorded after the instrument is withdrawn from the skin.

Alban, in U.S. Pat. No. 4,505,278, describes a device for algesimetry comprising a gas-type member such as a cylinder for confining a fixed amount of gas and a two-ended member such as a rod. The first end of the rod is pressed against the patient's body to apply gradually increasing pressure, and a second end acting much as a piston in a cylinder, decreases the volume of the fixed amount of gas. Indicia are provided for indicating how much the volume of gas decreases. Alban's device may also be modified to test materials for softness or firmness.

Yet another pain threshold gauge is disclosed in U.S. Pat. No. 2,704,539 to Fisher. Fisher discloses a pen-like instrument having a needle secured to one end of a compressible spring disposed within a tubular casing, the needle going through a bore in the front end of the casing. The other end of the spring is attached to a plunger within whose axial bore is a rotatable shaft having a spiral groove. An indicator pin carried by the plunger extends into this groove. When the needle is pressed against the skin, this acts to axially shift the plunger and thereby rotate the shaft and to cause the indicator pin to advance along a pressure indicating scale. The Fisher device is intended for use in determining paid thresholds and its sharp needle-like point renders it useless for applying precise pressure to the skin and underlying tissue non-invasively.

Kress, in U.S. Pat. No. 4,554,930, describes yet a further device useful for the prevention of pressure induced skin ulceration. The Kress device consists of a pressure sensor for continuously measuring the pressure on a patient's skin at the interface between the skin and a surface exerting pressure on the skin. A monitoring device monitors the pressure exerted on the skin and the elapsed time period during which the skin has been exposed to the measured pressure. An alarm then indicates when the combination of the pressure and the elapsed time is approaching a previously determined level in order to prevent damage to the patient's skin. The Cress device is particularly useful for preventing ulcer formation in patients that are bedridden.

All of the foregoing prior art inventions described devices for detecting levels of pressure which can result in either pain or cell damage. Except for the Alban device, they are all pointed instruments, having a needle-like probe tip which punctures the skin. In addition, all of the foregoing prior art devices, including Alban's, are designed to measure pain thresholds for diagnostic or preventative purposes.

Acupuncture points have been well known in China from earliest times and most of them are held to correspond to specific organs and areas of the body. Acupuncturists work by inserting needles of varying lengths at these points. When particular acupuncture points are stimulated, the corresponding areas being treated respond to the stimulation. Each acupressure point occupies only a very small area, approximately half of a square millimeter on the skin surface. An acupuncture point is highly sensitive and the feeling elicited in response to pressure is quite different from the surrounding tissues. The acupuncturist will, of course, insert his or her needle in such points but non-invasively pressing on the point can be almost as effective. After application of a therapeutic quantity of pressure to a particular acupuncture point, the length of time for which relief lasts will vary from patient to patient from a few minutes to several hours, or even days, but the effectiveness of the point will not diminish through use and the same result will be obtained time and time again.

It is well known that pressure is felt much more intensely by patients at acupuncture points than in adjacent areas to the extent that the pain is felt to be unbearable in the former while being, scarcely felt at all in the latter. It has been noted that Naloxone® brand of, a morphine antagonist which blocks the action of morphine and of endorphins in the brain, blocks the action of acupressure. Naloxone® also has the effect of preventing acupressure from relieving pain. Naloxone administered to a patient following acupressure also reverses the pain relief already produced by acupressure. This strongly suggests that acupuncture and acupressure acts by stimulating the production of endorphins.

Thus, it has become important to be able to deliver an accurately known pressure to a particular point upon the skin of the body in order to effect relief of pain and other symptoms. The foregoing prior art pain threshold devices simply do not meet the need of the acupuncturist physician or therapist in quantitatively and non-invasively delivering repeatable amounts of pressure to points such as fibromyalgic tender points and myofascial pain trigger points.

SUMMARY OF THE INVENTION

In view of the foregoing, the main object of this invention is to provide a device for applying a therapeutic amount of pressure to the skin and underlying tissue. The device includes a pressure sensor for measuring the pressure on the patient's skin and underlying tissue. A digital controller monitors the pressure exerted on the skin and the elapsed time period during which the skin has been exposed to the measured pressure. When the pressure reaches a predetermined level, a timer starts. When the combination of pressure and elapsed time reaches a previously determined level, this is so indicated by a digital readout or, optionally, a signal is given, which may be audio or visual.

Another object of this invention is to provide a device which can deliver a precise and repeatable therapeutic pressure to the skin and underlying tissue non-invasively.

DESCRIPTION OF THE PREFERRED EMBODIMENT

The invention is particularly intended to provide an instrument which will enable health care practitioners to determine with certainty, the non-invasive pressure being applied therapeutically to the skin and underlying tissue of a patient. With such an instrument, the practitioner is able to perform controlled studies concerning the determination of the optimum pressure necessary to effect a therapeutic and/or analgesic goal as, for example, when using acupressure.

In principle, most of the diagnostic algesimeters (pain threshold gauges) listed under the Description of the Prior Art could be adapted for therapeutic application by replacing the sharp needle tip with a blunt non-invasive tip. Thus, a blunt tipped cap or the like that is adapted to fit over the needle-like tip of a prior art algesimeter could provide a satisfactory instrument for applying quantitative pressure to the skin and underlying tissue to effect, for example, symptomatic relief or analgesia. Thus, in its simplest form, the instant invention is an algesimeter wherein the sharp point, designed to quickly reach a patient's pain threshold, is replaced with a blunt tip suitable for the controlled application of therapeutic pressure.

Prior art algesimeters achieve their desired effect (i.e. applying a pressure to the skin to reach the patient's pain threshold) by applying a modest force over a surface area the size of a needle tip. Thus a high pressure is obtained with a very small force. A much larger force must be applied to a blunt non-invasive tip to deliver the same pressure to the skin of a patient. Therefor, due to the large difference in forces applied, it may not be possible to inexpensively convert an algesimeter force/pressure measurement to a therapeutic force/pressure measurement in all cases.

Figure 1:
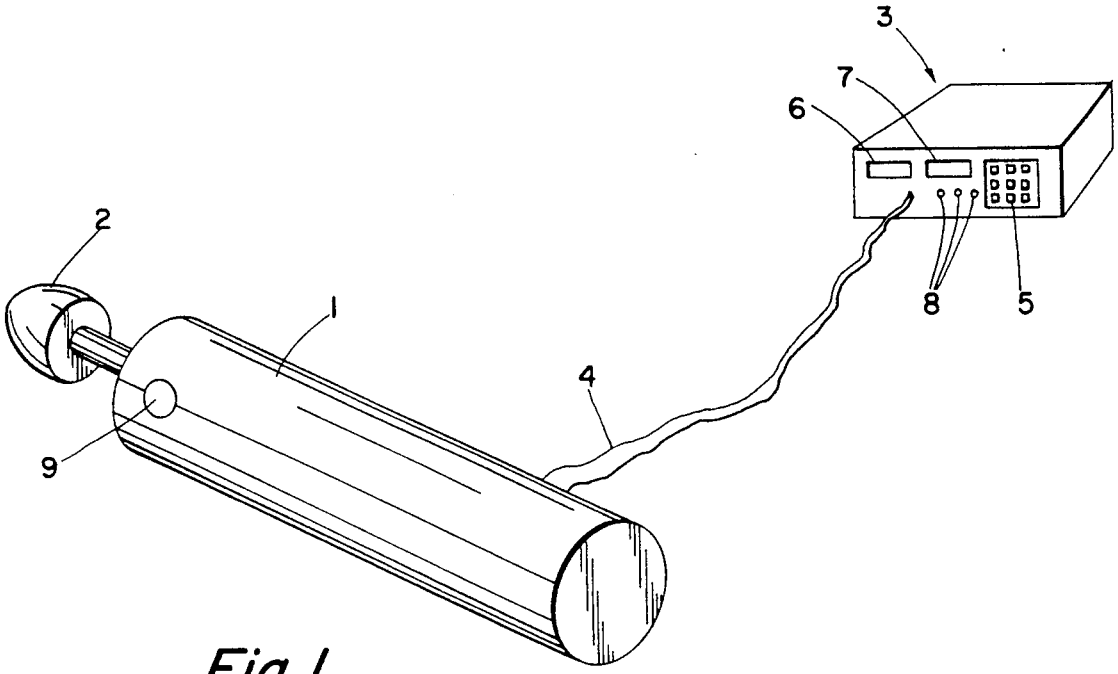
FIG. 1 is a perspective view of a quantitative acupressure device in accordance with the invention.
Figure 2:
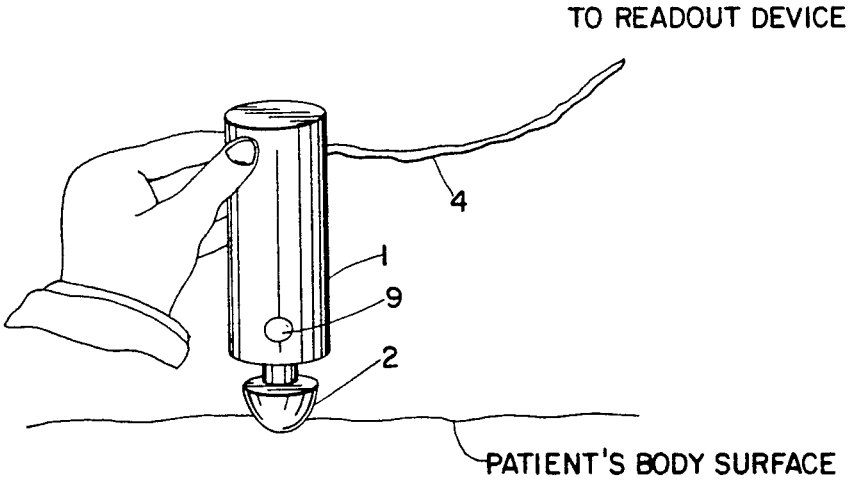
FIG. 2 illustrates the manner in which the instrument is used.
Figure 3:
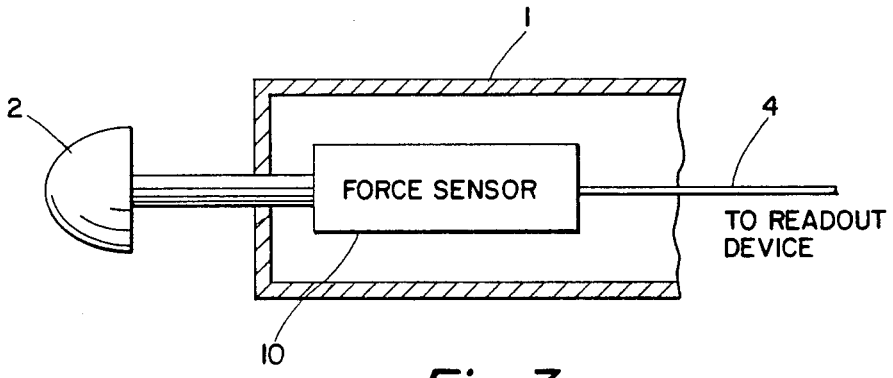
FIG. 3 shows the transducer circuit.
Figure 4:
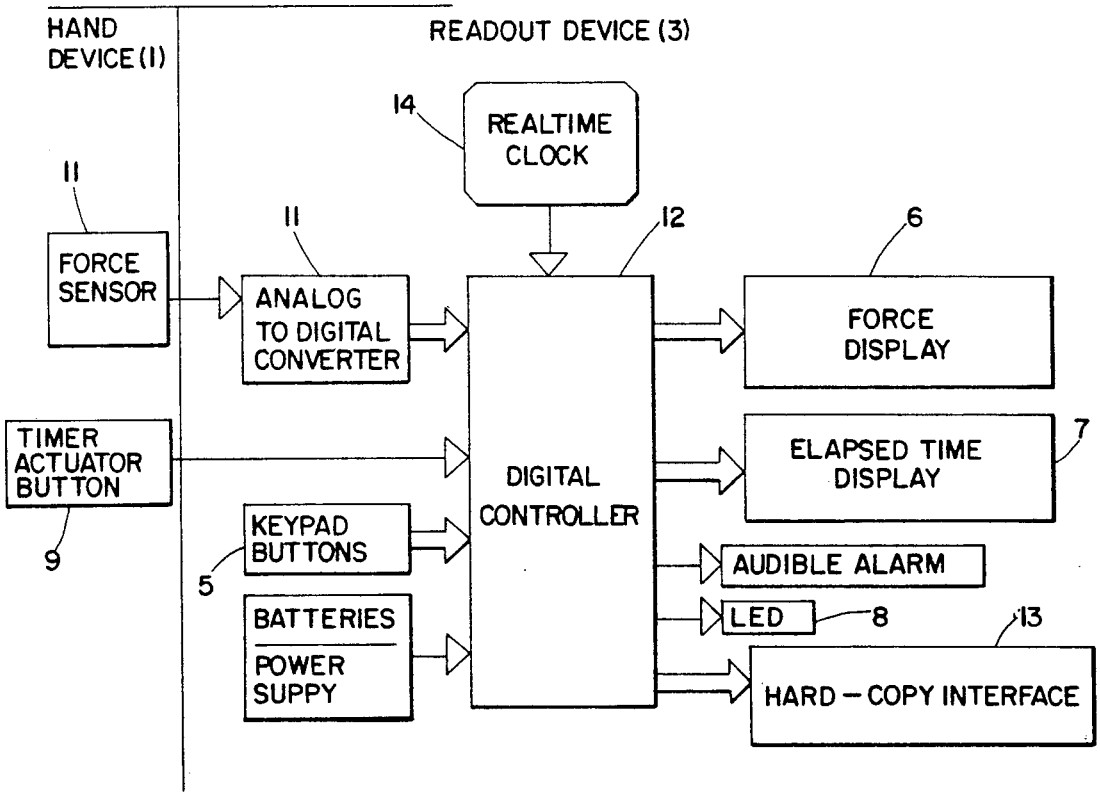
FIG. 4 is a schematic diagram of the instrument components.

A particularly preferred embodiment which is suitable for the non-invasive delivery of therapeutic pressure to the skin and underlying tissue of a patient is shown schematically in FIG. 1. A handle (1) has a blunt tip probe (2) extending therefrom connected to a readout device (3) by means of electrical wires (4). The readout device (3) houses the signal A/D converter and digital controller (FIG. 4) keypad buttons (5), LCD displays (6 & 7), timers (FIG. 4), as well as the battery and/or power supply (FIG. 4) To use the device, the practitioner grasps the handle (1) and, if a predetermined excess force set point is desired, enters this value via the keypad buttons (5). This excess force set point is stored as a reference force value in the digital controller (FIG. 4). Next, the practitioner presses the blunt-tip probe (2) against the skin of the patient in the manner shown in FIG. 2. If the applied pressure, which is monitored by the digital controller and shown on the "force" digital display (6) reaches the predetermined set point, an audible alarm (FIG. 4) sounds and warning LED (8) lights indicating that excessive pressure is being applied to this patient. The pressure must then be reduced to silent the alarm and extinguish the LED. If at any time during the application of pressure to the patient the practitioner presses the timer actuator (9) on the handle (1), the elapsed time appears on the "time" digital display (7) and continues to increment until the timer actuator (9) is pressed again when it is held to the current elapsed time. Pressing the timer actuator (9) a third time resets the elapsed time to zero for the next pressure application. The values of force and elapsed time are also presented at the hard-copy interface (FIG. 4) for archival and/or plotting purposes. The general layout of the force sensor (10) in relationship to the handle (1) and blunt tip (2) is shown in FIG. 3.

Turning now to FIG. 4, a signal responsive to the applied force is fed from a force sensor (10) to the signal A/D converter (11) where it is converted into a digital representation and monitored by the digital controller (12). The converted force is displayed on the "force" digital display (6) in engineering units of either pounds or kilograms depending on the mode set by the operator via the keypad buttons (5). The converted force is also presented to the hard-copy interface (13) in ASCII format. A digital signal is fed from the timer actuator (9) located on the force handle (1) to the digital controller (12). This timer actuator (9) controls the operation of the "time" digital display (7). Initially, this display is at zero. When the timer actuator (9) is pressed and released, the display (7) indicates elapsed time in seconds until the timer actuator (9) is pressed and released a second time. The display of elapsed time is then held until the timer actuator (9) is pressed and released a third time when the display resets back to zero. The elapsed time is also presented to the hard-copy interface (13) in ASCII format along with time of day from the realtime clock (14).

While I have illustrated and described a preferred embodiment of my invention, it is understood that many modifications of the preferred embodiment are possible, and I therefore do not wish to be limited to the precise details set forth, but desire to avail myself of such changes and alterations as fall within the purview of the following claims.

What I claim is:

1. A quantitative accupressure device for non-invasively applying therapeutic pressure to tissue underlying the skin of a patient, said device comprising:

(a) a sensor portion, said sensor portion comprising, in combination, a handheld force transducer and a blunt-tipped probe, the blunt-tipped probe being incapable of puncturing the skin of the patient when the device is used to apply therapeutic pressure of the tissue underlying the skin, means connecting said transducer and said probe so that when the tip of the probe is pressed against the skin said transducer yields an output signal quantitatively related to the applied pressure; and (b) a readout device comprising means for converting said transducer output signal into a visual display of the magnitude of the applied pressure.

* * * * *